US008573727B2

(12) United States Patent
Iwai

(10) Patent No.: US 8,573,727 B2
(45) Date of Patent: Nov. 5, 2013

(54) INKJET PRINTING APPARATUS AND CARRIAGE CONTROL METHOD FOR CONTROLLING CARRIAGE SPEED

(75) Inventor: Isao Iwai, Saitama (JP)

(73) Assignee: Canon Kabushiki Kaisha, Tokyo (JP)

( * ) Notice: Subject to any disclaimer, the term of this patent is extended or adjusted under 35 U.S.C. 154(b) by 137 days.

(21) Appl. No.: 13/224,664

(22) Filed: Sep. 2, 2011

(65) Prior Publication Data

US 2012/0092402 A1 Apr. 19, 2012

(30) Foreign Application Priority Data

Oct. 18, 2010 (JP) ..... 2010-234008

(51) Int. Cl.
*B41J 29/38* (2006.01)

(52) U.S. Cl.
USPC ..... 347/14

(58) Field of Classification Search
USPC ..... 347/14, 37; 400/322; 369/30.17; 700/29
See application file for complete search history.

(56) References Cited

U.S. PATENT DOCUMENTS 4,359,289 A * 11/1982 Barrus et al. ..... 400/322
6,628,576 B1 * 9/2003 Watanabe et al. ..... 369/30.17
6,823,132 B2 11/2004 Saito et al.
7,606,624 B2 * 10/2009 Cullen ..... 700/29
2005/0146555 A1 * 7/2005 Igarashi et al. ..... 347/37

FOREIGN PATENT DOCUMENTS

JP 3658340 B2 6/2005

* cited by examiner

*Primary Examiner* — Stephen Meier
*Assistant Examiner* — Carlos A Martinez
(74) *Attorney, Agent, or Firm* — Fitzpatrick, Cella, Harper & Scinto

(57) ABSTRACT

A carriage is precisely controlled in short-distance movement. The carriage is controlled upon printing by an inkjet printhead by reciprocally moving the carriage to which the printhead is mounted along a guide rail by a driving force supplied from a carriage motor. More specifically, a carriage position in the reciprocal direction is detected, and a carriage speed is calculated based on the detected positions. Then, the positions and carriage speed are fed back to control drive of the carriage motor. In the feedback-control, a loss due to friction generated between the carriage and the guide rail is compensated for with respect to a motor instruction value used to control drive of the carriage motor. The compensation is performed by identifying, based on the carriage speed, whether the friction is static or kinetic, and determining a compensation value in accordance with the identification.

7 Claims, 6 Drawing Sheets

INKJET PRINTING APPARATUS AND CARRIAGE CONTROL METHOD FOR CONTROLLING CARRIAGE SPEED

BACKGROUND OF THE INVENTION

1. Field of the Invention

The present invention relates to an inkjet printing apparatus and carriage control method. Particularly, the present invention relates to an inkjet printing apparatus and carriage control method for printing an image on a printing medium by moving a carriage to which a printhead is mounted.

2. Description of the Related Art

Printing apparatuses mounted in a printer, copying apparatus, facsimile apparatus, and the like are conventionally configured to print an image (including a character and symbol) on a printing medium such as paper or a plastic film (for example, an OHP sheet) based on image information. These printing apparatuses are classified by the printing method of a printing means for use into an inkjet type, wire dot type, thermo-sensitive type, heat transfer type, laser beam type, and the like.

Of these printing apparatuses, a printing apparatus of the inkjet type (to be referred to as an inkjet printing apparatus) prints by discharging ink from an inkjet printhead (to be referred to as a printhead) serving as a printing means onto a printing medium such as printing paper. The inkjet printing apparatus can advantageously downsize the printing means and quickly print a high-resolution image.

In some cases, stable ink discharge becomes difficult at only a specific nozzle out of a plurality of nozzles which are formed in a printhead and discharge ink. The specific nozzle is called a failure nozzle. The failure nozzle cannot print satisfactorily, and a portion having a print failure in a printed image causes print unevenness. As a result, stripe-like density unevenness appears on the printed image.

To detect such an ink discharge failure using an optical sensor, it is necessary to align the optical axis of light irradiated from the optical sensor with the nozzle array of the printhead and discharge ink from each nozzle so as to cross the light path. In this case, the moving amount of the printhead from a reference position (home position) to the optical axis is set in advance. The printhead is moved by this moving amount, aligning the optical axis of the optical sensor with the nozzle array of the printhead. For recent higher-resolution color printed images, the interval between a plurality of nozzle arrays arranged in a printhead for color printing is decreasing, and higher alignment precision is required.

There is also proposed a method of implementing quick, high-precision position control even in the presence of an individual difference in the friction between an alignment control target such as a carriage and a carriage movement mechanism and the difference in use environment (see, for example, Japanese Patent No. 3,658,340).

When the printhead discharges ink, mist-like small droplets (to be referred to as mist) are created in addition to ink droplets which form an image. The mist is attached to every portion within the printing apparatus. Depending on how much and where the mist attaches, the friction characteristic (static friction and kinetic friction) between the carriage guide rail and the carriage changes.

Japanese Patent No. 3,658,340 proposes a method of compensating for the static friction by specifying the initial value of an integral compensation amount calculated by integral processing in PI control generally used as a feedback control method.

However, the conventional method considers only the static friction. The integral compensation amount varies when the static friction increases such that it is much more than the kinetic friction. Especially in a high-precision alignment operation, persistent oscillations are generated near the target position. For this reason, the alignment and output often take time. In addition, the nozzle array of the printhead and the optical axis of the optical sensor sometimes do not match each other, and no ink discharge failure can be detected. This results in poor printed image quality.

SUMMARY OF THE INVENTION

Accordingly, the present invention is conceived as a response to the above-described disadvantages of the conventional art.

For example, a printing apparatus and carriage control method according to this invention are capable of aligning a carriage at high precision even by short-distance movement.

According to one aspect of the present invention, there is provided a printing apparatus which prints on a printing medium by discharging ink from an inkjet printhead while reciprocating, along a guide rail which guides and supports a carriage, the carriage to which the inkjet printhead is mounted, comprising: a carriage motor configured to supply a driving force for moving the carriage; a detection unit configured to detect a position of the carriage in a direction of the reciprocation; a calculation unit configured to calculate a carriage speed based on a position detection signal output from the detection unit; a feedback control unit configured to control drive of the carriage motor by feeding back the position detection signal obtained from the position of the carriage that has been detected by the detection unit and a speed signal indicating the carriage speed calculated by the calculation unit; a compensation unit configured to compensate for a loss due to friction generated between the carriage and the guide rail with respect to a motor instruction value used to control the drive of the carriage motor by the feedback control unit; and an identification unit configured to identify, based on the speed signal calculated by the calculation unit, whether the friction is static friction or kinetic friction, and determine a compensation value of the compensation unit in accordance with the identification.

According to another aspect of the present invention, there is provided a carriage control method for a printing apparatus which prints on a printing medium by discharging ink from an inkjet printhead while reciprocating, by a driving force supplied from a carriage motor along a guide rail which guides and supports a carriage, the carriage to which the inkjet printhead is mounted, comprising: detecting a position of the carriage in a direction of the reciprocation; calculating a carriage speed based on a position detection signal output upon the detecting; controlling drive of the carriage motor by feeding back the position detection signal obtained from the detected position of the carriage and a speed signal indicating the calculated carriage speed; compensating for a loss due to friction generated between the carriage and the guide rail with respect to a motor instruction value used to feedback-control the drive of the carriage motor; and identifying, based on the calculated speed signal, whether the friction is static friction or kinetic friction, to determine a compensation value for the compensation in accordance with the identification.

The invention is particularly advantageous since high-precision alignment can be still performed even when, for example, mist is attached to a carriage and guide rail and this changes the friction characteristic of the carriage moving mechanism.

Further features of the present invention will become apparent from the following description of exemplary embodiments (with reference to the attached drawings).

DESCRIPTION OF THE EMBODIMENTS

An exemplary embodiment of the present invention will now be described in detail in accordance with the accompanying drawings.

In this specification, the terms "print" and "printing" not only include the formation of significant information such as characters and graphics, but also broadly include the formation of images, figures, patterns, and the like on a print medium, or the processing of the medium, regardless of whether they are significant or insignificant and whether they are so visualized as to be visually perceivable by humans.

Also, the term "print medium" not only includes a paper sheet used in common printing apparatuses, but also broadly includes materials, such as cloth, a plastic film, a metal plate, glass, ceramics, wood, and leather, capable of accepting ink.

Furthermore, the term "ink" (to be also referred to as a "liquid" hereinafter) should be extensively interpreted similar to the definition of "print" described above. That is, "ink" includes a liquid which, when applied onto a print medium, can form images, figures, patterns, and the like, can process the print medium, and can process ink. The process of ink includes, for example, solidifying or insolubilizing a coloring agent contained in ink applied to the print medium.

Figure 1:
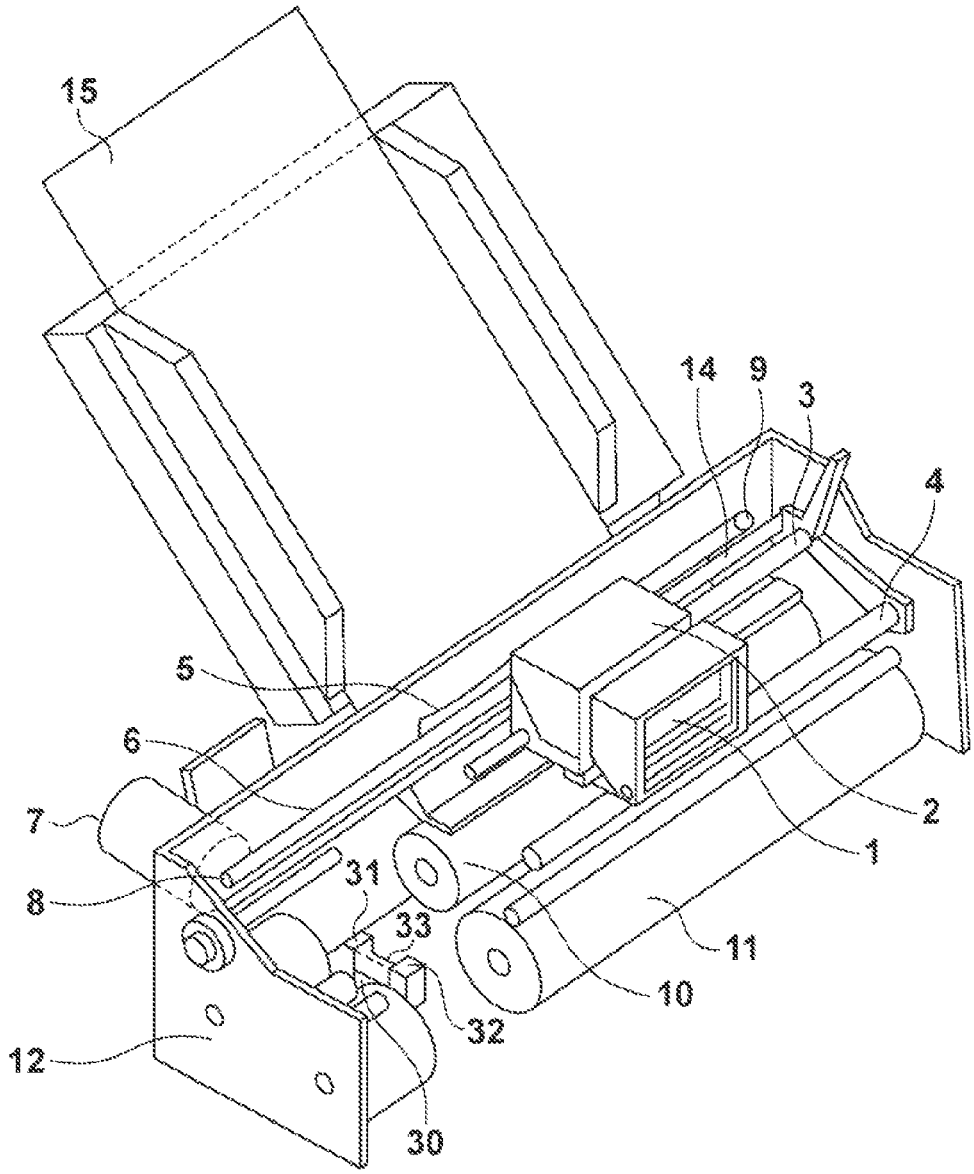
FIG. 1 is a perspective view showing the schematic arrangement of an inkjet printing apparatus as a typical embodiment of the present invention.

FIG. 1 is a perspective view showing the schematic arrangement of an inkjet printing apparatus (to be referred to as a printing apparatus) as a typical embodiment of the present invention.

As shown in FIG. 1, a carriage 2 is an electromechanical part to which an inkjet printhead (to be referred to as a printhead) 1 is mounted. A main guide rail 3 and sub-guide rail 4 guide and support the carriage 2. The main guide rail 3 and sub-guide rail 4 are guide members to which the carriage 2 is attached in a direction crossing (in general, perpendicular to) the conveyance direction of a printing medium 15 so that the printhead 1 keeps an almost predetermined interval with respect to the printing medium 15.

A housing 12 supports the main guide rail 3 and sub-guide rail 4. A timing belt 6 is looped between a motor pulley 8 coupled to a carriage motor 7 and a driven pulley 9 arranged at a position opposite to the carriage motor 7. The timing belt 6 is fixed to the carriage 2. A driving force from the carriage motor 7 is transferred and supplied to the carriage 2 via the timing belt 6. The carriage 2 then reciprocates on a printing medium. A conveyance roller 10 is driven by a conveyance motor (not shown) to convey the printing medium 15. A discharge roller 11 discharges a printing medium bearing an image from the apparatus.

The printing apparatus includes an optical sensor 30 to detect no-failure/failure of ink discharge from the printhead. The optical sensor 30 is arranged outside the printing region of the printhead 1 and near the home position of the printhead 1. The optical sensor 30 includes a light-emitting portion 31 which emits light, and a light-receiving portion 32 which receives the light. The printhead 1 discharges ink at a position where an optical axis 33 connecting the light-emitting portion 31 and light-receiving portion 32 coincides with the nozzle array of the printhead. The optical sensor 30, then, detects ink discharge no-failure/failure.

Note that the ink discharge detection mechanism using an optical sensor is well known, and a more detailed description thereof will be omitted. In the printing apparatus, the carriage 2 needs to be accurately moved to the position of the optical sensor 30 to determine ink discharge no-failure/failure.

Figure 2:
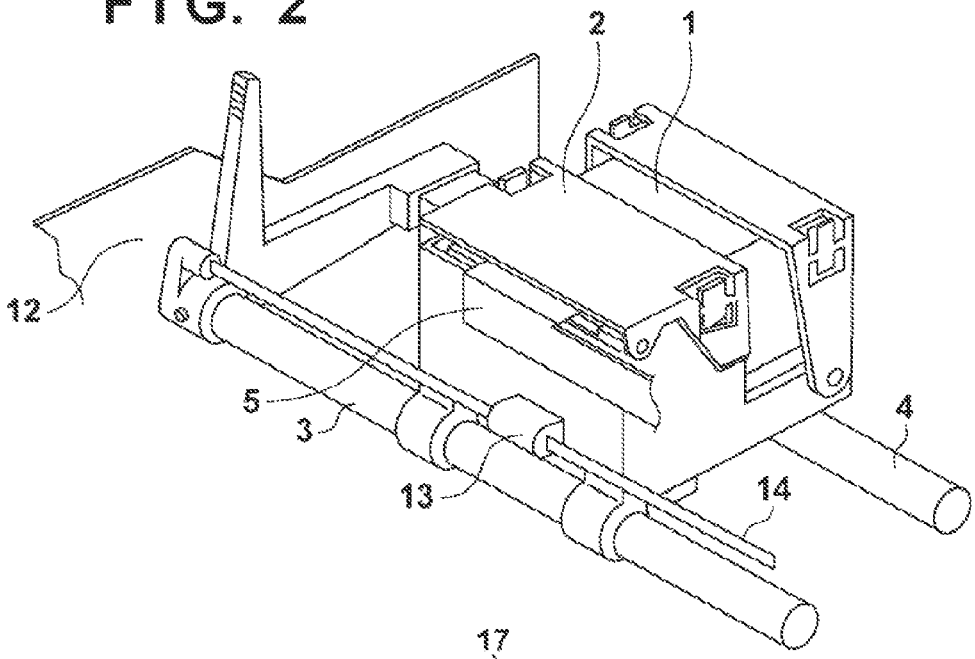
FIG. 2 is a perspective view showing the arrangement of a carriage in the printing apparatus shown in FIG. 1.

FIG. 2 is a perspective view showing the arrangement of the carriage 2 in the printing apparatus shown in FIG. 1.

Referring to FIG. 2, an encoder sensor 13 attached to the carriage 2 reads the slit of an encoder scale 14 arranged parallel to the moving direction of the carriage 2. A position detection signal output from the encoder sensor 13 is transferred to the control unit of the printing apparatus via a flexible board 5. The control unit detects the position of the carriage 2 in the scanning direction by counting pulses of the pulse-like position detection signal obtained by reading the slit of the encoder scale 14. Also, the control unit detects the speed of the carriage 2 from the time interval between the pulses.

Figure 3:
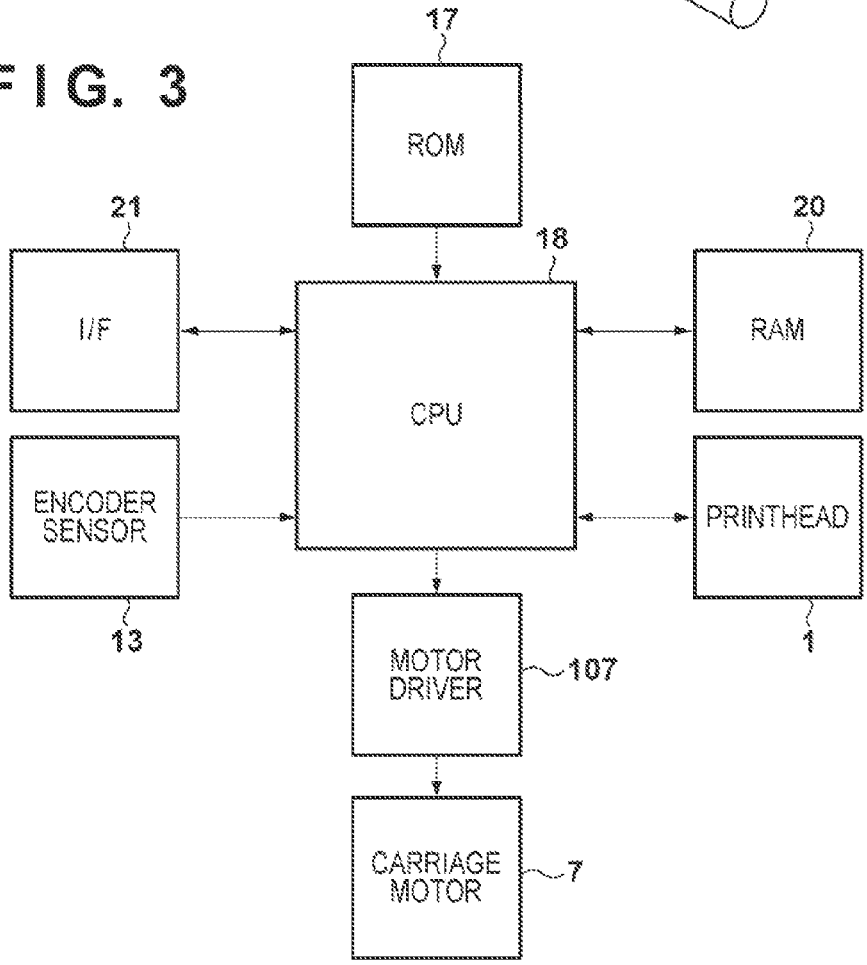
FIG. 3 is a block diagram showing the arrangement of the control unit of the printing apparatus.

FIG. 3 is a block diagram showing the arrangement of the control unit of the printing apparatus.

In the control unit, a CPU 18 loads a program stored in a ROM 17 and executes it to perform arithmetic processing. The arithmetic processing executed by the CPU 18 includes image processing, communication with a host computer (to be referred to as a host) via an interface (I/F) 21, control of discharge from the printhead 1, processing of an output signal from the encoder sensor 13, and calculation of a control output to the motor driver 107.

Note that arithmetic processing by the CPU 18 may be reduced by configuring printing apparatus-specific functions as hardware embedded in an ASIC (not shown). The ROM 17 stores a control program for controlling the printing apparatus, data necessary for execution, and the like. A RAM 20 is used to temporarily store programs to be executed by the CPU 18, print data transmitted from the host, and the like. A motor driver 107 is a circuit which modulates the pulse voltage width based on the result of arithmetic processing by the CPU 18 to adjust a voltage to be applied to the carriage motor 7 and drive the carriage motor 7.

Figure 4:
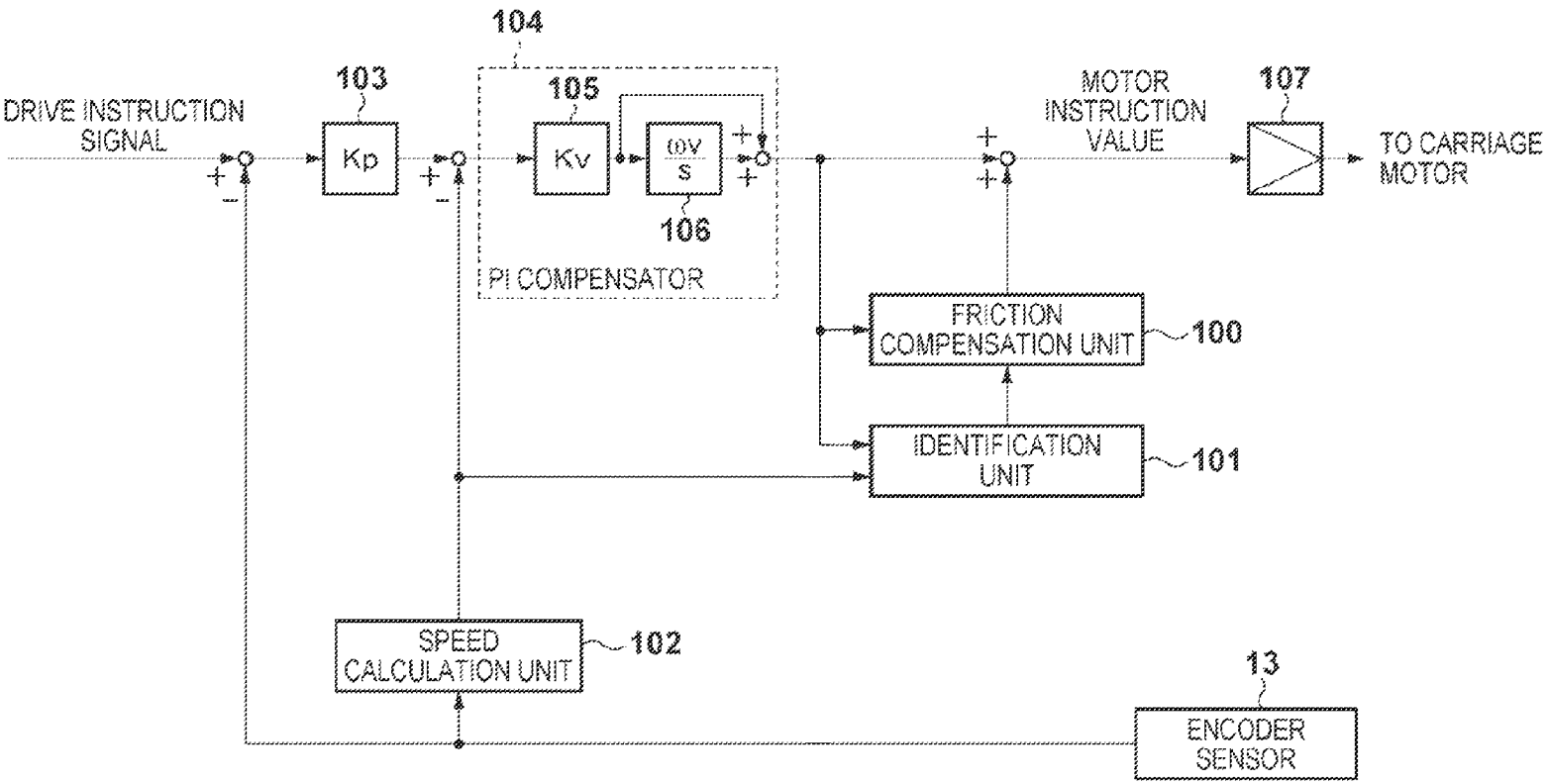
FIG. 4 is a block diagram showing the detailed functional arrangement of a carriage control unit.

FIG. 4 is a block diagram showing the detailed functional arrangement of a carriage control unit. The encoder sensor 13, CPU 18, and motor driver 107 implement the function of the carriage control unit in cooperation with each other. Alternatively, the ASIC (not shown) may provide part of the function executed by this arrangement.

A drive instruction signal shown in FIG. 4 is the drive profile of the carriage 2 that is programmed in advance. A speed calculation unit 102 calculates the speed of the carriage 2 from a position detection signal output from the encoder sensor 13. Control units 103 and 104 perform feedback (FB)

control calculation to follow a drive instruction signal based on the position detection signal of the carriage 2 that has been output from the encoder sensor 13 and a speed signal derived from the position detection signal.

In this arrangement, the control unit 104 performs PI compensation control using a proportional unit 105 and integral unit 106 as the FB control calculation method. However, the method is arbitrary as long as calculation is performed so that the carriage 2 follows a drive instruction signal. This also applies to the control unit 103.

An output from the control unit 104 and an output from a friction compensation unit 100 are added, and the sum serves as a motor instruction value. The motor driver 107 performs pulse width modulation (PWM) in accordance with the motor instruction value, and drives the carriage motor 7.

When ink mist is attached to the carriage 2, main guide rail 3, and sub-guide rail 4, the friction characteristic of the carriage driving mechanism changes.

Figure 5:
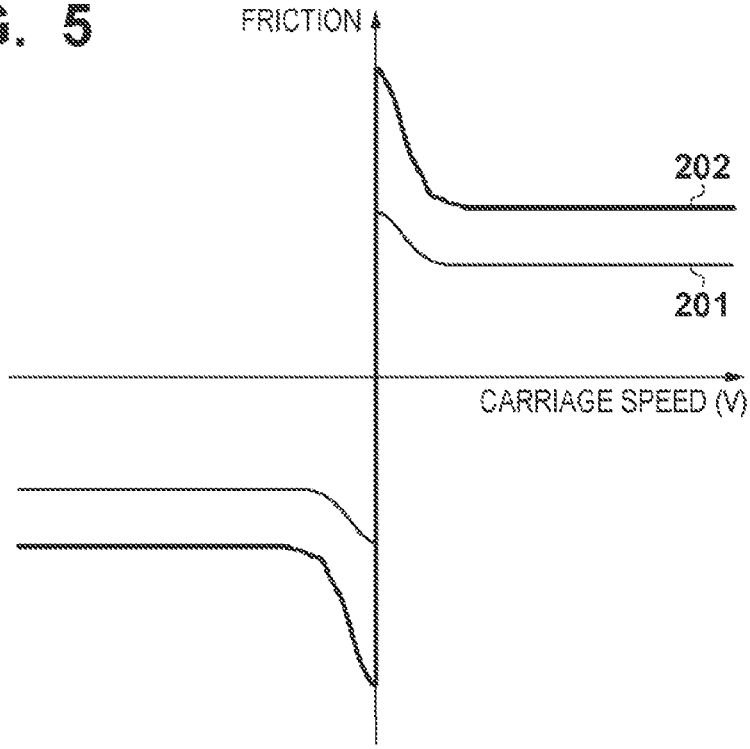
FIG. 5 is a graph showing the friction characteristic between the carriage and the guide rail.

FIG. 5 is a graph showing the friction characteristic between the carriage and the guide rail. In FIG. 5, the abscissa indicates the carriage speed, and the ordinate indicates the magnitude of friction of the carriage. In general, friction at a carriage speed v of "0" is called static friction, and one at a high carriage speed is called kinetic friction. Referring to FIG. 5, a thin line 201 indicates a friction characteristic when no mist is attached to the guide rail and carriage bearing. A thick line 202 indicates a friction characteristic when a large amount of mist is attached. FIG. 5 reveals that attachment of mist increases the friction as a whole, and the static friction increases much more than the kinetic friction.

The friction compensation unit 100 compensates for a loss by the static friction and kinetic friction, and reflects the compensation in feedback control.

Figure 6:
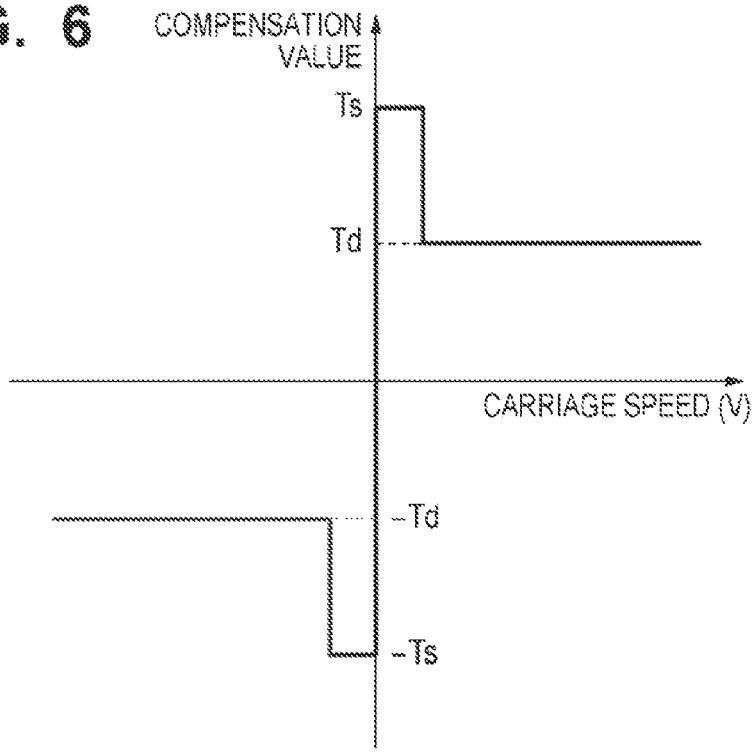
FIG. 6 is a graph showing the relationship between a compensation value supplied from a friction compensation unit and the carriage speed v.

FIG. 6 is a graph showing the relationship between a compensation value supplied from the friction compensation unit 100 and the carriage speed v.

As shown in FIG. 6, the compensation value is a motor instruction value Ts corresponding to the static friction at the carriage speed v of almost "0", and a motor instruction value Td corresponding to the kinetic friction at a carriage speed other than the vicinity of "0". The compensation value is switched using an output (speed signal) from the speed calculation unit 102. An identification unit 101 (to be described later) determines these motor instruction values. As a matter of course, the compensation value may be switched between Ts and Td in every rotational direction of the carriage motor.

The operation of the identification unit 101 which obtains the compensation values Td and Ts will be explained.

The identification unit 101 executes drive based on an expected shortest-distance drive profile as preliminary drive. The drive distance in a normal printing operation is about 10,000 pulses in terms of the number of pulses of a position detection signal from the encoder sensor 13. In preliminary drive, the drive distance is about 100 pulses. The preliminary drive includes drive for moving, by a short distance from the home position to the position of the optical sensor 30, the carriage 2 to which the printhead 1 is mounted.

Figure 7:
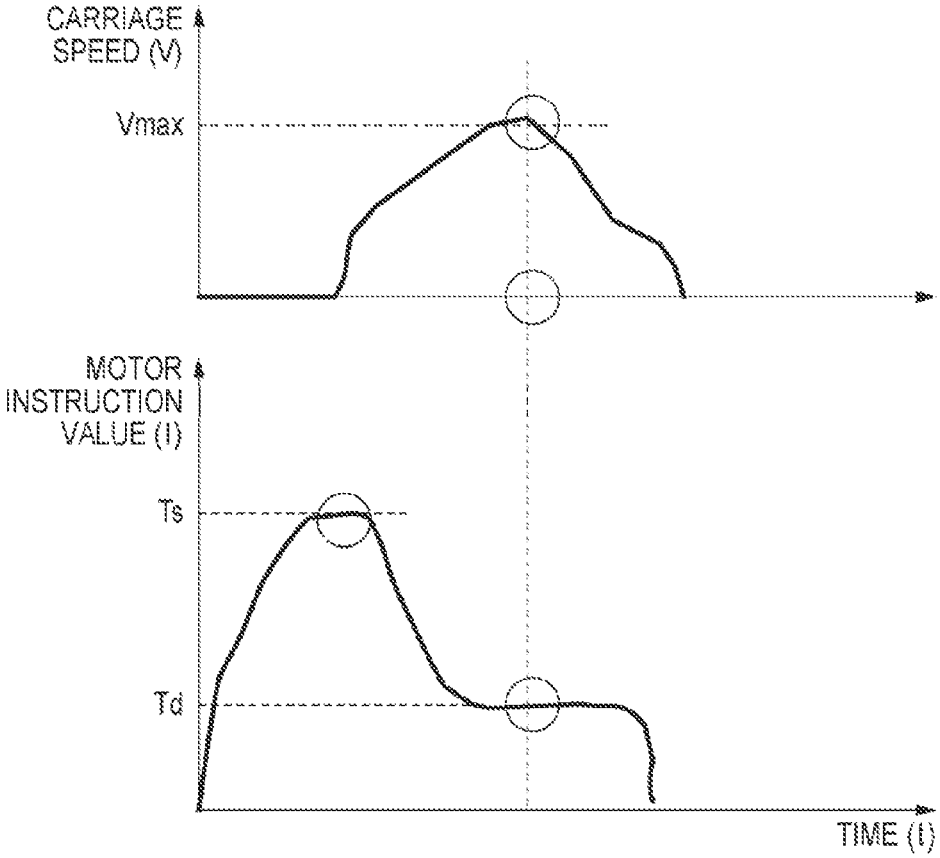
FIG. 7 is a graph showing changes of the carriage speed and motor instruction value over time in preliminary drive.

FIG. 7 is a graph showing changes of the carriage speed and motor instruction value over time in preliminary drive.

The carriage control unit temporarily records, in the RAM 20, the carriage speed v obtained from the speed calculation unit 102 and a motor instruction value I. The carriage control unit obtains the maximum value Ts of the motor instruction value I and the motor instruction value Td at the maximum carriage speed Vmax. It is also possible to perform the preliminary drive operation a plurality of number of times, store the obtained values Ts and Td in the RAM 20, and set their averages as Ts and Td. The obtained results are used as outputs from the friction compensation unit 100.

Figure 8:
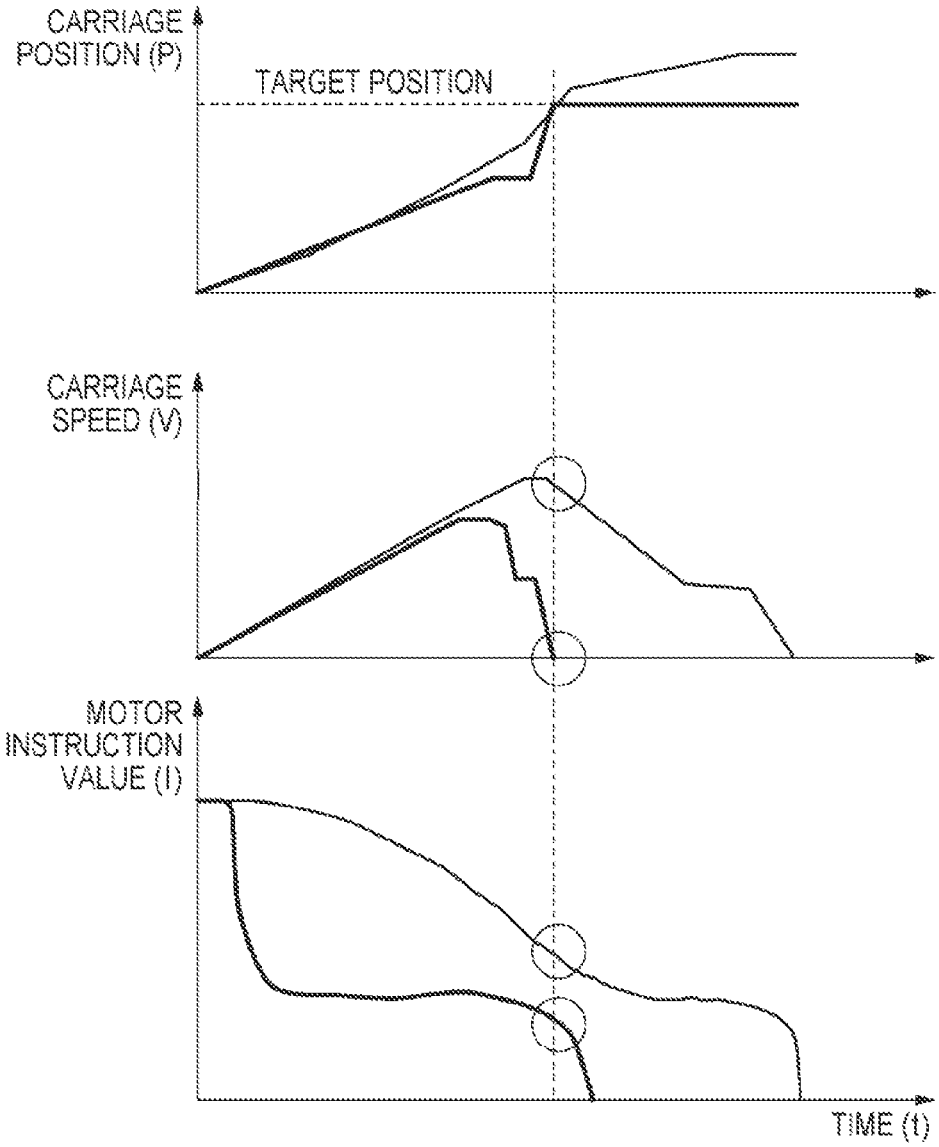
FIG. 8 is a graph showing changes of the carriage position, speed, and motor instruction value over time.

FIG. 8 is a graph showing changes of the position P, speed v, and motor instruction value I of the carriage 2 over time. In FIG. 8, a thin line indicates a result obtained by a conventional method, and a thick line indicates a result obtained according to the embodiment.

When the static friction becomes larger than the kinetic friction, a large initial value is given to the integration term for friction compensation in the conventional method. At a short moving distance, even if the carriage reaches the vicinity of the target position, the influence of the initial value still remains and the integration term does not decrease satisfactorily. As a result, the motor instruction value and carriage speed do not decrease sufficiently, and the carriage passes the target position.

To the contrary, the embodiment compensates for both the static friction and kinetic friction. Even when the static friction increases more than the kinetic friction, the friction compensation value is set to Ts to increase the motor instruction value I until the carriage 2 starts moving. After the carriage starts moving (that is, it has passed through the static friction region), the friction compensation value is changed to Td to decrease the motor instruction value I.

According to the above-described embodiment, even at a short carriage moving distance, when the carriage reaches the vicinity of the target position, the motor instruction value and carriage speed have satisfactorily decreased, and the carriage can stop at the target position.

Hence, the carriage to which the printhead is mounted can be accurately moved to the position of the optical sensor in the printing apparatus in which the optical sensor for detecting ink discharge is arranged at a short distance from the home position of the printhead. Even if the friction characteristic of the carriage driving mechanism changes due to mist, the position of the nozzle array of the printhead and the optical axis of the optical sensor can be accurately aligned. No-failure/failure of ink discharge from the printhead can be accurately detected.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-234008, filed Oct. 18, 2010, which is hereby incorporated by reference herein in its entirety.

What is claimed is:

1. A printing apparatus which prints on a printing medium by discharging ink from an inkjet printhead while reciprocating, along a guide rail which guides and supports a carriage, the carriage to which the inkjet printhead is mounted, comprising:

a carriage motor configured to supply a driving force for moving the carriage;

a detection unit configured to detect a position of the carriage in a direction of the reciprocation;

a calculation unit configured to calculate a carriage speed based on a position detection signal output from said detection unit;

a feedback control unit configured to control drive of said carriage motor by feeding back the position detection signal obtained from the position of the carriage that has been detected by said detection unit and a speed signal indicating the carriage speed calculated by said calculation unit;

a compensation unit configured to compensate for a loss due to friction generated between the carriage and the guide rail with respect to a motor instruction value used to control the drive of said carriage motor by said feedback control unit; and an identification unit configured to identify, based on the speed signal, whether the friction is static friction or kinetic friction, and determine a compensation value of said compensation unit in accordance with the identification, wherein a motor instruction value corresponding to the static friction is used as the compensation value when the carriage speed is in the vicinity of "0", and a motor instruction value corresponding to the kinetic friction is used when the carriage speed is a speed higher than the vicinity of "0".

2. The apparatus according to claim 1, wherein said identification unit determines the compensation value of said compensation unit based on a speed signal of the carriage that has been obtained by preliminarily driving the carriage and a motor instruction value.

3. The apparatus according to claim 1, wherein the motor instruction value corresponding to the static friction is larger than the motor instruction value corresponding to the kinetic friction.

4. A printing apparatus which prints on a printing medium by discharging ink from an inkjet printhead while reciprocating, along a guide rail which guides and supports a carriage, the carriage to which the inkjet printhead is mounted, comprising:

a carriage motor configured to supply a driving force for moving the carriage;

a detection unit configured to detect a position of the carriage in a direction of the reciprocation;

a calculation unit configured to calculate a carriage speed based on a position detection signal output from said detection unit;

a feedback control unit configured to control drive of said carriage motor by feeding back the position detection signal obtained from the position of the carriage that has been detected by said detection unit and a speed signal indicating the carriage speed calculated by said calculation unit;

a compensation unit configured to compensate for a loss due to friction generated between the carriage and the guide rail with respect to a motor instruction value used to control the drive of said carriage motor by said feedback control unit; and an identification unit configured to identify, based on the speed signal, whether the friction is static friction or kinetic friction, and determine a compensation value of said compensation unit in accordance with the identification, wherein said identification unit determines the compensation value of said compensation unit based on a speed signal of the carriage that has been obtained by preliminarily driving the carriage and a motor instruction value.

5. The apparatus according to claim 4, further comprising an optical sensor configured to be arranged near a home position of the inkjet printhead and detect no-failure/failure of ink discharge from the inkjet printhead, wherein the preliminary drive includes drive for moving the carriage by a short distance from the home position to said optical sensor.

6. A carriage control method for a printing apparatus which prints on a printing medium by a printhead while reciprocating, by a driving force supplied from a carriage motor along a guide rail which guides and supports a carriage, the carriage to which the printhead is mounted, comprising:

detecting a position of the carriage in a direction of the reciprocation;

obtaining a moving speed of the carriage;

controlling drive of the carriage motor by feeding back at least one of the detected position and the moving speed of the carriage;

compensating for a loss due to friction generated between the carriage and the guide rail with respect to a motor instruction value used to feedback-control the drive of the carriage motor; and identifying, based on the moving speed, whether the friction is static friction or kinetic friction, to determine a compensation value for the compensation in accordance with the identification, wherein a motor instruction value corresponding to the static friction is used as the compensation value when the moving speed is in the vicinity of "0", and a motor instruction value corresponding to the kinetic friction is used when the moving speed is higher than the vicinity of "0".

7. The method according to claim 6, wherein the motor instruction value corresponding to the static friction is larger than the motor instruction value corresponding to the kinetic friction.

* * * * *